US005134763A

United States Patent [19]

Schulz, Jr. et al.

[11] Patent Number: 5,134,763

[45] Date of Patent: Aug. 4, 1992

[54] CORE INSERT MACHINE AND PROCESS

[75] Inventors: Martin Schulz, Jr.; Billie G. Pieper, both of Brenham, Tex.

[73] Assignee: Steadley Company, Carthage, Mo.

[21] Appl. No.: 678,062

[22] Filed: Apr. 1, 1991

[51] Int. Cl.[5] ..... B68G 7/00

[52] U.S. Cl. ..... 29/91; 29/91.1; 29/281.1; 29/714; 29/451; 414/798.3

[58] Field of Search ..... 29/91, 281.1, 281.5, 29/451, 565, 91.1, 714; 269/153; 414/798.2, 798.3, 798.4; 5/254, 475, 481

[56] References Cited

U.S. PATENT DOCUMENTS 1,936,389 11/1933 Hallquist ..... 267/33
2,469,596 5/1949 Groom ..... 5/254
4,234,984 11/1980 Stumpf ..... 53/467 X

*Primary Examiner*—Joseph M. Gorski
*Assistant Examiner*—S. Thomas Hughes
*Attorney, Agent, or Firm*—Lee, Mann, Smith, McWilliams, Sweeney & Ohlson

[57] ABSTRACT

A machine for inserting foam cores within the coil springs of a mattress or similar device having a series of spiral coil springs. The machine has a series of hollow receptacles for accommodated the cores above and aligned with one row of coil springs of the mattress. Beneath the mattress, a series of grippers is located in alignment with the receptacles. When actuated, the grippers rise through the coil springs, grip the bottom of each foam core, and return through the coils, placing each core in the center of each of the coils of the row of coils. The mattress is then indexed, and the process repeated for the next row of coils.

16 Claims, 4 Drawing Sheets

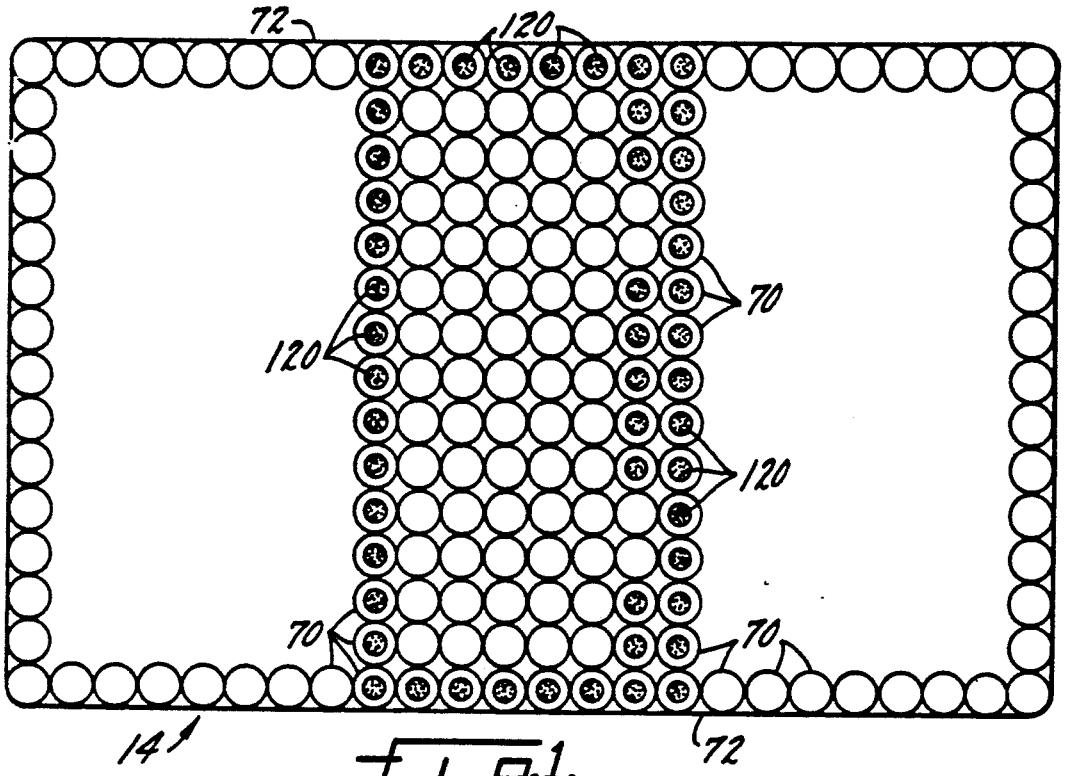
Fig. 1.
Fig. 2.
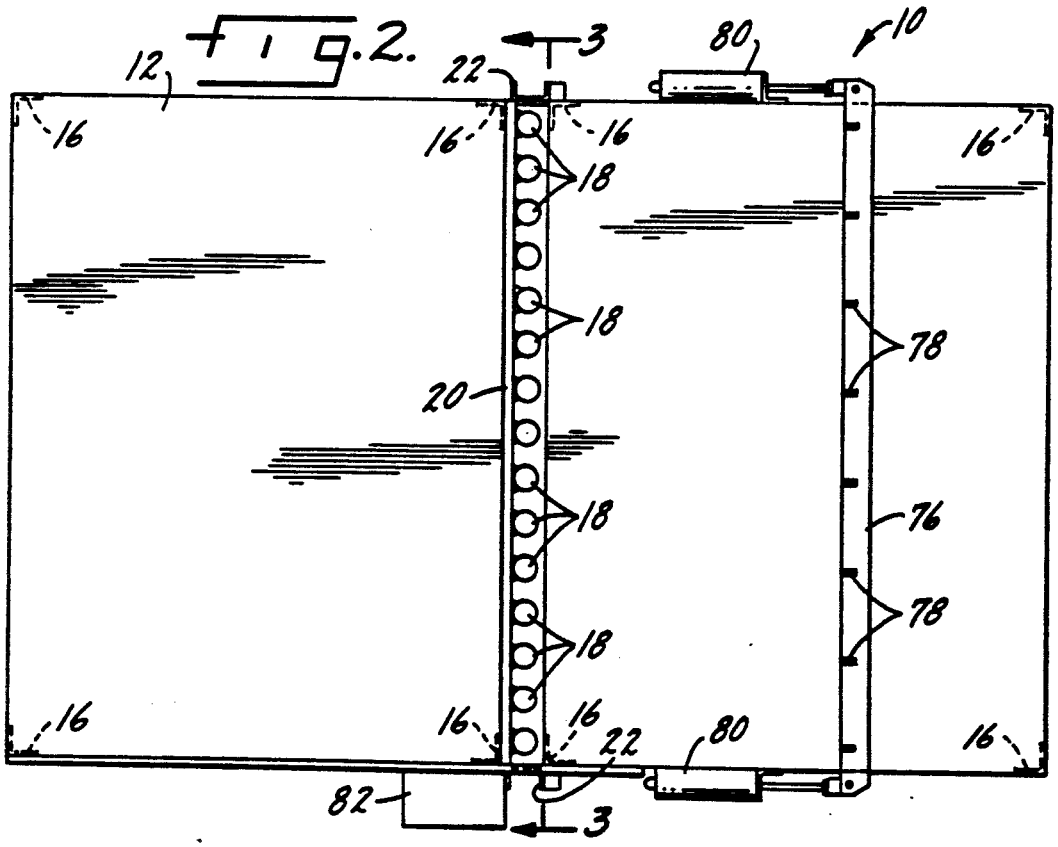

CORE INSERT MACHINE AND PROCESS

BACKGROUND OF THE INVENTION

This invention relates to mattress foundations and similar devices employing a series of coil support springs, and in particular to an apparatus and process for inserting foam cores into coil springs, the cores being used to increase the firmness of the mattress foundation in the vicinity of the coil having the inserted foam core.

Mattresses, and similar foundations and other structures, are typically composed of a series of longitudinal columns and lateral rows of coil springs which are contained within upper and lower outer border wires. In a mattress, the coils are attached to one another and the outer borders by a series of pigtail wires. Normally, for ease and correctiveness of assembly, the coil springs are identical to one another throughout the mattress foundation, and therefore spring characteristics throughout the mattress foundation are generally identical since the coil springs are the sole support in the mattress.

It has often been desired to increase the firmness in a mattress, for many reasons. In the central area of the mattress, because that area is the primary weight bearing area, it is often desired to strengthen the supporting coils in that area to avoid premature failure of the mattress. In some installations, the peripheral edges of the mattress are often sat upon, and are an area of failure. Strengthening in these areas also leads to longer life of the mattress. In addition, because a mattress will often sag at its edges when weight is applied, additional edge support also provides an increase in the effective usable surface area of the mattress.

Strengthening cores have been applied to springs for added firmness. For example, U.S. Pat. No. 1,936,389 discloses installation of an elastic core to a spring, while U.S. Pat. No. 2,469,596 discloses inserting a foam core in a spring. In either patent, added firmness and increased longevity of the coil springs are the result.

A significant problem inhibiting the use of foam cores in coil springs has been simply the process of physically inserted a core in a spring. Because the foam core normally has a diameter slightly larger than the diameter of the smallest convolution of the spring, it is difficult to force a foam core into a spring, and thus time consuming. Until the present invention, no aid has been available for assisting the ready insertion of foam cores into coil springs. Also, no machine has been known to selectively insert cores into springs only in areas in which increased firmness has been sought.

SUMMARY OF THE INVENTION

The present invention relates to an apparatus for inserting foam cores into springs of a structure, such as a mattress or similar unit, having a plurality of parallel rows and columns of coil springs. The apparatus includes means for retaining a plurality of foam cores in registration with one row of coil springs and at one side of the structure, with each core being retained in alignment with one coil spring. A plurality of gripping means is located at the other side of the structure, each of the gripping means being in alignment with one core when held by the retaining means. Means is provided for inserting the gripping means into and withdrawing the gripping means from the one row of coil springs, and means is also provided for activating each gripping means to cause the gripping means to grip and release a foam core.

In accordance with the preferred form of the invention, the means for retaining the cores comprises a plurality of spaced, hollow receptacles, each of the receptacles being shaped to accommodate one core. The receptacles are cylindrical in configuration with open ends, and include means to prevent a core from being withdrawn from one end of the receptacle when inserted through that end. The means for preventing comprises a series of teeth which project into the receptacle and are angled to allow the core to be pulled from the opposite end of the receptacle, but not allow the core to be withdrawn from its inserted end.

Each of the gripping means is located in a hollow, elongated barrel shaped to pass axial through a coil spring. The barrels are secured to a transverse bar, the bar being mounted for movement toward and away from the receptacles. A series of air cylinders, secured to the bar, insert and withdraw the gripping means from the coil springs of the structure.

In accordance with the preferred form of the invention, each of the gripping means comprises a pair of opposed jaws. A drive member engages each pair of jaws, and is shaped to open and close the jaws as the drive member is driven. An activation rod engages each drive member, and a header is connected to each activation rod. A series of air cylinders are secured to the header for activation of the gripping means.

Means is provided for indexing the structure to align a second row of coil springs with the gripping means and the retaining means once a series of foam cores has been inserted. The indexing means includes a series of hooks secured to an advancement member, with a pair of air cylinders connected to the advancement member for advancing the structure forwardly the distance of one coil spring so that the next series of foam cores can be inserted in the next row of springs.

In operation, the receptacles are loaded with foam cores, and a mattress foundation is oriented beneath the receptacles with the coil springs of one row of springs being aligned with the cores. The gripping means are then raised from the other side of the foundation, with each of the gripping means rising axial through one of the coil springs. The gripping means are then activated to spread the jaws and close the jaws on the bottom end of each of the foam cores, and the process is then reversed to return the gripping means in the opposite direction to draw the foam cores axially into the coils. Once the coils are in place, the jaws are opened to release the foam cores. The process is then repeated by advancing the mattress foundation to place another row of coils beneath the core receptacles, and then repeat the insertion sequence.

BRIEF DESCRIPTION OF THE DRAWINGS

The invention is described in greater detail in the following description of an example embodying the best mode of the invention, taken in conjunction with the drawing figures, in which:

FIG. 1 is a top plan view of a mattress foundation, with some coil springs being eliminated for clarity, and with some foam cores having been inserted in some of the coil springs, FIG. 2 is a top plan view of an apparatus according to the invention for inserting foam cores into the springs of a mattress foundation, such as that shown in FIG. 1.

DESCRIPTION OF AN EXAMPLE EMBODYING THE BEST MODE OF THE INVENTION

Figure 3:
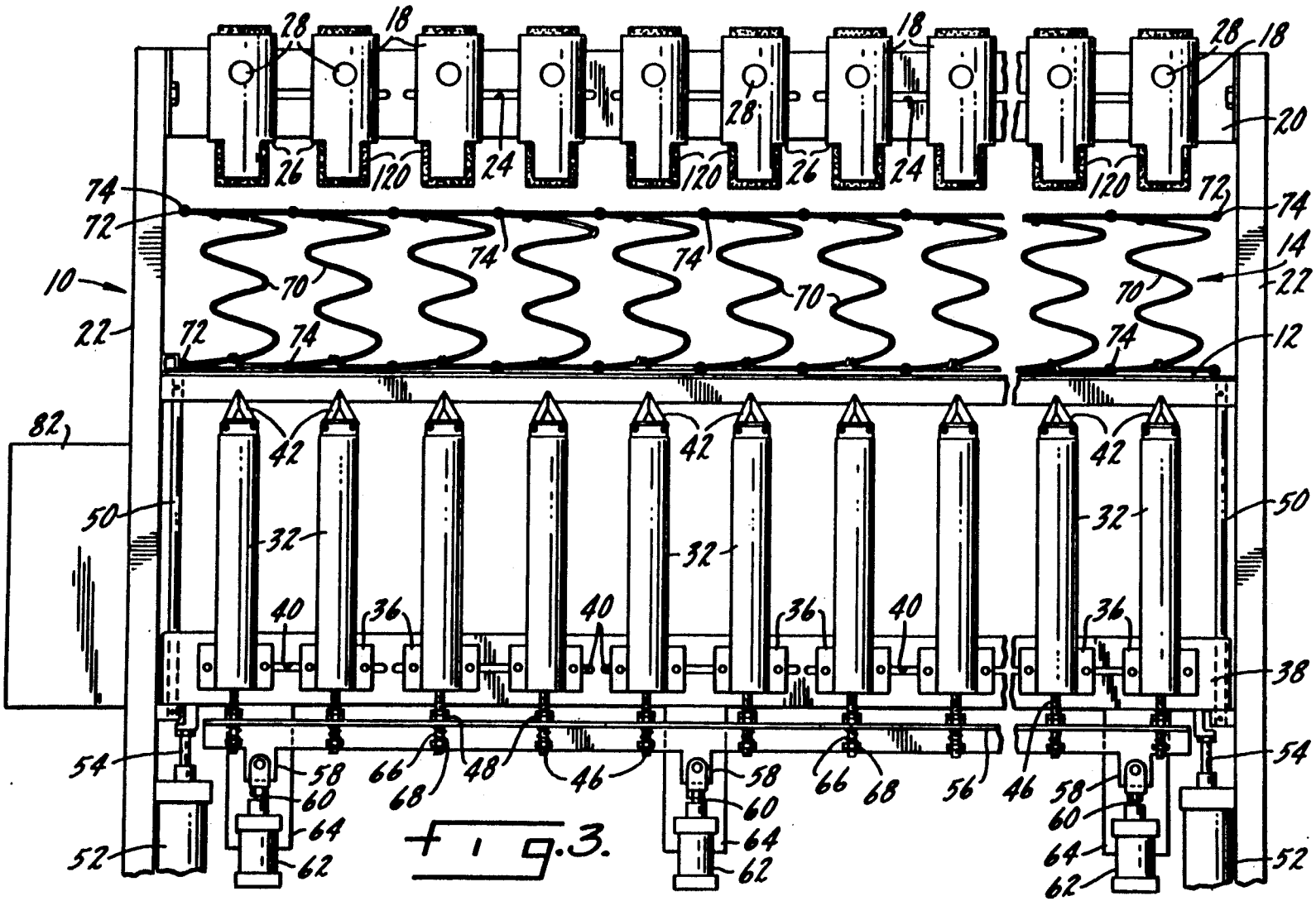
FIG. 3 is an enlarged cross sectional view taken along lines 3—3 of FIG. 2, partially truncated, and showing the apparatus of the invention prior to activation to cause the gripping means to rise through the coil springs of the mattress foundation to grip foam cores held in receptacles poised above the mattress foundation.
Figure 4:
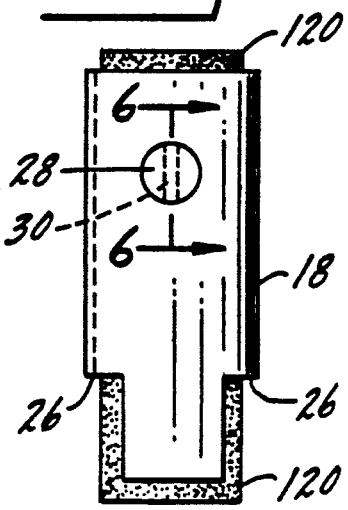
FIG. 4 is an elevational view of one of the core-holding receptacles according to the invention.
Figure 5:
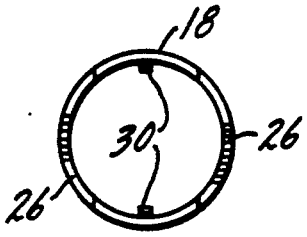
FIG. 5 is a top plan view thereof, without an inserted core.
Figure 6:
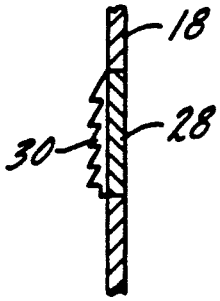
FIG. 6 is an enlarged cross sectional view taken along lines 6—6 of FIG. 4, showing the core retaining teeth.

A core inserting machine according to the invention is shown generally at 10 in the drawing figures. The machine 10 includes a horizontal table or bed 12 which forms a support for a mattress foundation, such as a mattress foundation 14 shown in FIG. 1, as the foundation is advanced through the machine 10. The bed 12 is supported on a series of legs 16, as appropriate.

A series of core-holding receptacles 18 are poised above the bed 12. The receptacles 18 are mounted on a horizontal support 20 which, in turn, is bolted to opposite vertical legs 22 secured to opposite sides of the bed 12. Because different mattress foundations 14 may have differing spacing of the coil springs thereof, the support 20 is provided with a series of slots 24, and the receptacles are secured to the support 20 by a bolt (not illustrated) extending from the rear of each receptacle 18 through the respective slot 24, and being secured by a nut or in an otherwise appropriate fashion.

Each of the receptacles 18 is hollow and cylindrical, with open ends. The bottom of each of the receptacles includes opposite cutaway notches 26 to accommodate jaws of the gripping means, as described in greater detail below. For retaining foam cores within each receptacle 18, each receptacle has a pair of opposite plugs 28, each carrying a series of teeth 30 sloped downwardly so that a foam core can be inserted through the top of a receptacle 18 and withdrawn form the bottom of the receptacle, but cannot be drawn back through the top of the receptacle 18 due to the inclination of the teeth 30.

A plurality of gripping devices 32 are located beneath the bed 12 and in alignment with the receptacles 18. Each of the gripping devices 32 comprises a hollow, elongated barrel 34 having a bracket 36 at one end which is secured to a transverse bar 38. Again, because the coil springs of the mattress foundation 14 may vary in their positioning within the mattress foundation, the transverse bar 38 has a series of longitudinal slots 40 to which the brackets 36 are attached for adjustability in a conventional fashion.

The gripping devices 32 are identical in form and function to the individual core insert tool of the applicants' copending U.S. patent application Ser. No. 07/678,064, entitled "Core Insert Tool and Process", and filed on the same date as the filing date of the present application. The disclosure of this copending application is incorporated herein by reference for greater detail concerning the gripping devices 32. Each of the gripping devices includes a pair of jaws 42 pivotally attached to the barrel 34, and activated by a drive member 44 which is threadedly engaged by one end of an activation rod 46. Nuts 48 are threaded on the rod 46 for use in driving the rod 46 to open and close the jaws 42.

The transverse bar 38, with its mounted gripping devices 32, is in turn mounted for vertical movement on a pair of vertical rods 50 which are appropriately secured at one end beneath the bed 12 and at the other end to a bracket attached to a leg 22. A pair of air cylinders 52, also secured to the respective legs 22, have their rams 54 attached to the transverse bar 38. Extension of the rams 54 raises the transverse bar 38 to insert the gripping devices 32 in respective coils of the foundation unit 14. Retraction of the rams 54 returns the transverse bar 38 to the orientation shown in FIG. 3.

The activation rods 46 of each of the gripping devices 32 emerge from the respective barrels 34 and extend through an angle member 56 in the form of a header for driving the activation rods 46. The header 56 has extending tabs 58 which are attached to rams 60 of respective air cylinders 62. The air cylinders 62 are attached to plates 64 which, in turn, are secured to the transverse bar 38.

Figures 8, 9, 10, 11, 12, 13, 14, 15:
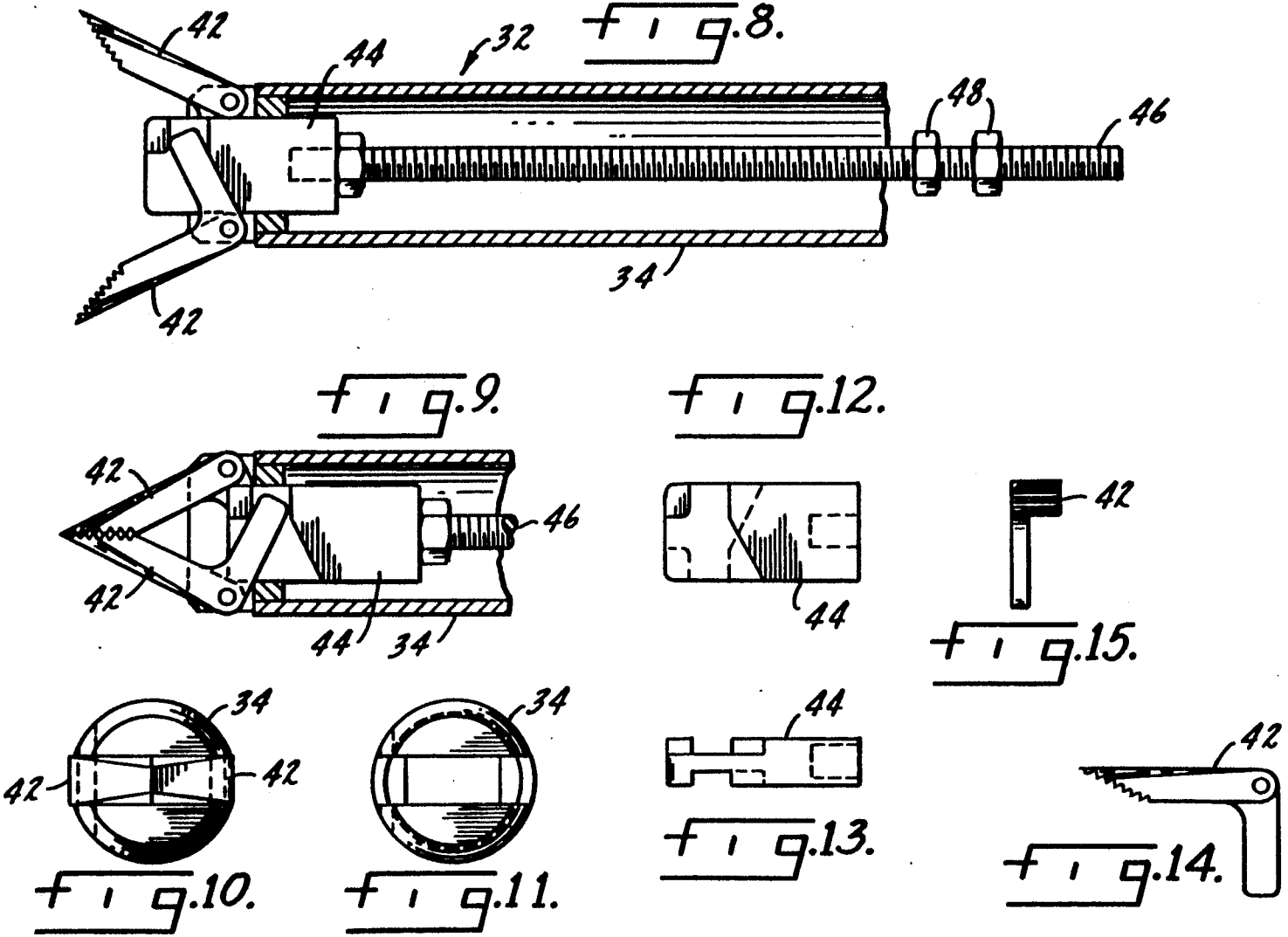
FIG. 8 is an enlarged view, partially in section and partially broken away, of one of the gripping means according to the invention with the gripping jaws opened.
FIG. 9 is a partial view of the left end of the gripping means shown in FIG. 8, with the jaws closed.
FIG. 10 is an end view of the tool of FIG. 8, showing the jaws closed.
FIG. 11 is a view similar to FIG. 10, but with the jaws removed.
FIG. 12 is a plan view of a drive member according to the invention for activating the jaws.
FIG. 13 is a second view of the drive member of FIG. 12, rotated 90° about its axis in relation to the orientation shown in FIG. 12.
FIG. 14 is an elevational view of one of the gripping jaws according to the invention.
FIG. 15 is an end elevational view of the jaw of FIG. 14.

The header 56 is slotted (not illustrated) in a fashion similar to the slots 40 of the transverse bar 38 to accommodate shifting adjustment of each of the gripping devices 32. The extending activation rods 46 pass through the slots in the header 56, and a compression spring 66, bearing against a third nut 68, is used to secure each of the activation rods 46 to the header 56. When the rams 60 of the air cylinders 62 are extended, the header 56 is raised upwardly (in relation to FIG. 3), raising the activation rods 46 within the gripping devices 32, and spreading the jaws 42. Retraction of the rams 60 reverses the process, and closes the jaws 42 to the orientation shown in FIGS. 3 and 9.

The mattress foundation 14 is composed of a plurality of parallel rows and columns of coil springs 70. The springs extend, in a conventional fashion, between upper and lower border members 72, and are secured to one another and to the border members 72 by means of a series of conventional wire pigtails 74. As is conventional, the coil springs 70 are formed with a widest convolution at either side of the mattress foundation 14, and narrow to a central waist before broadening toward the other end. For ease of illustration, only the outer convolutions of the coil springs 70 are illustrated in FIG. 1.

The mattress foundation 14 is indexed along the table 12 by means of a flat advancement member 76 having a series of upwardly extending hooks 78. The hooks are positioned to engage coils 70 of the mattress foundation 14 when placed on the bed 12, and the advancement member 78 is indexed to the right (FIG. 2) by means of a pair of air cylinders 80 secured to the bed 12.

Figure 7:
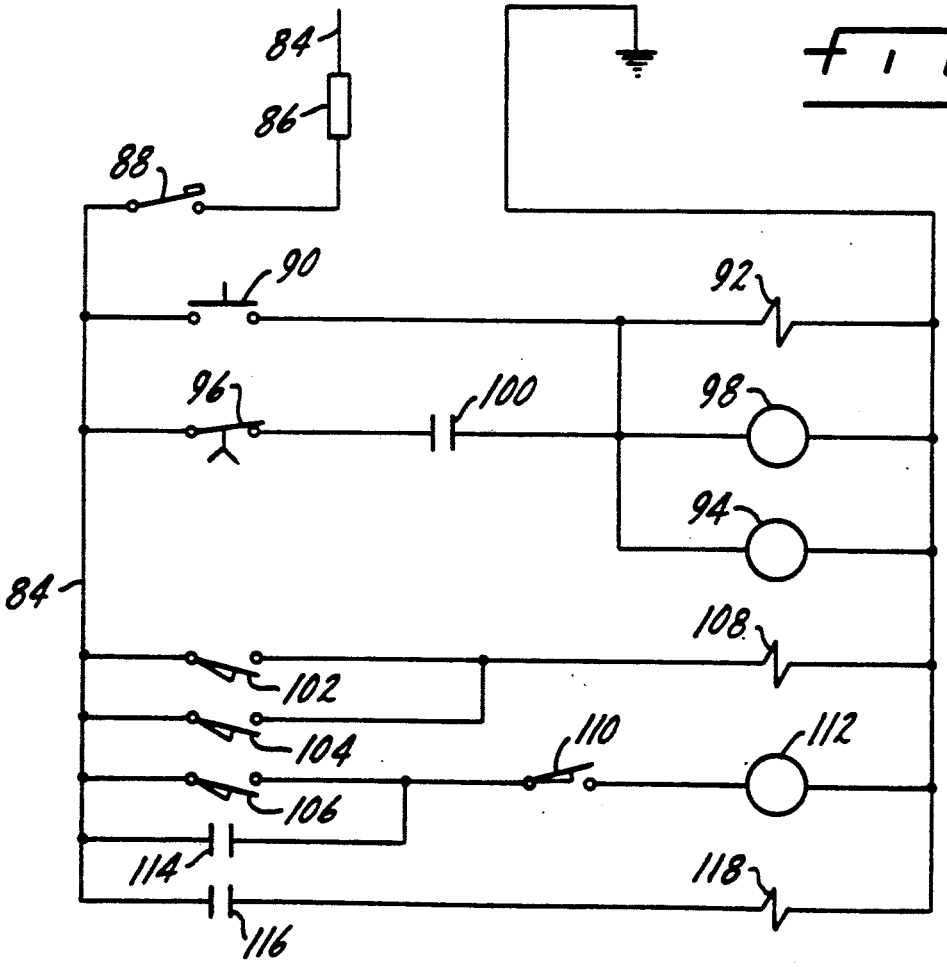
FIG. 7 is a schematic diagram of wiring for operating the apparatus according to the invention.

A schematic diagram for operating the machine 10 is shown in FIG. 7. Various components of the diagram shown in FIG. 7 will be mounted in a control box 82, while other elements are already described above, or, as in the case of micro switches, are located appropriately to be engaged by moving components of the machine 10 as the machine 10 is operated.

The circuit of FIG. 7 includes a power line 84 leading from an appropriate source of alternating current (not illustrated) and having an appropriate overload fuse 86. A toggle switch 88 is used to deengergize the remainder of the operating circuitry.

A normally open push button 90 is used to begin circuit operation. The push button 90 is electrically connected to an operator 92 for the air valves 52, a time delay 94 which has a normally closed timer contact 96, and a relay 98 having a normally open relay contact 100. Also connected to the power line 84 are three normally open micro switches 102, 104 and 106, the switches 102 and 104 being connected also to an operator 108 for the air cylinders 62. A normally closed micro switch 110 is connected between the micro switch 106 and a relay 112, which has a pair of normally open contacts 114 and 116 connected to the power line 84. The contact 116 is also attached to an operator 118 for the air cylinders 80.

The basic operation of the machine 10 is as follows. First, before activation of the machine 10, a mattress foundation 14 is placed on the bed 12, with the first row of coils which are to be filled with foam cores being located beneath the receptacles 18 and above the gripping devices 32. The receptacles 18 and gripping devices 32 are adjusted to assure that the gripping devices 32 will rise axially in the various coil springs 70 of the mattress foundation 14, while the receptacles 18 are located axially thereabove.

If all of the coil springs 70 are to be filled with foam cores, each of the receptacles 18 is filled with a foam core 120. Similarly, if any areas of the mattress foundation are to be left without a central foam core within one or more of the coil springs 70, appropriate receptacles 18 are left blank by simply not inserting one of the foam cores 120.

The air cylinders 52 are then activated, raising the transverse bar 38, and causing the gripping devices 32 to penetrate through the table 12 (apertures not illustrated) into the respective coil springs 70. As the gripping devices 32 approach the receptacles 18, the jaws 42 are opened to the orientation shown in FIG. 8. When the bar 38 reaches the top of its travel, the jaws 42 are closed, gripping the foam cores 120. The cylinders 52 are then deactivated, returning the gripping devices 32 in the downward direction, and drawing the foam cores 120 from their receptacles 18 axially into the coil springs 70. As the bar 38 approaches the end of its travel, the jaws 42 are reopened, releasing the cores to be retained within the coil springs 70. The jaws 42 are then reclosed when the bar 38 reaches the end of its downward travel, poising the gripping devices 32 for another upward excursion. At that point, the cylinders 80 are activated, advancing the advancement member 76 to the right (FIG. 2), and advancing the mattress foundation 14 so that a second row of coil springs 70 is located between the upper receptacles 18 and the lower gripping devices 32. When the receptacles 18 are refilled, the process is then repeated until the desired foam cores 120 have been appropriately located in the mattress foundation 14.

As shown in FIG. 1, and as explained above, the foam cores 120 are installed in certain of the coil springs 70 of the mattress foundation 14, depending on the desired firmness characteristics. The locations shown in FIG. 1 are simply for the purposes of illustration, and do not necessarily suggest a particular configuration of foam cores 120 in relation to the coil springs 70.

Turning to the circuitry of FIG. 7, to initiate the cycle of the machine 10, the push button 90 is depressed. Doing so activates the operator 92 for the air cylinders 52, and also activates a time delay 94 which closes its delay contacts 96. Also, a relay 98 is activated, closing its contacts 100. Thus, the transverse bar 38 begins its upward excursion. During this time, the normally closed micro switch 110 remains closed.

As the bar 38 approaches the top of its travel, the normally open micro switch 102 is closed, activating the operator 108 to energize the cylinders 62, thus opening the jaws 42. When the bar 38 reaches the top of its excursion, the micro switch 102 is deactivated, deactivating the operator 108, causing the jaws 42 to close upon the foam cores 120. Also, the micro switch 106 is closed, activating the relay 112, enclosing the relay contacts 114 and 116.

The delay of the time delay 94 is set so that when the bar 38 reaches the top of its excursion, the delay is exhausted, and the time delay 94 thus opens its contacts 96. This, in turn, deenergizes the relay 98, opening the relay contacts 100, and also deenergizes the operator 92, deenergizing the air cylinders 52. Deenergization of the air cylinders 52 begins downward excursion of the bar 38, withdrawing the foam cores 120 from their receptacles 18 and drawing them axially into the coil springs 70. During the downward excursion, the micro switch 106 is deactivated, but since the micro switch 110 is closed, the now-closed contacts 114 and 116 keep the relay 112 on, and also activate the operator 118, to activate the cylinders 80 to draw the advancement member 76 to the left (FIG. 2).

When the bar 38 is almost at the bottom of its excursion, the micro switch 104 is activated, activating the operator 108 and opening the jaws 42 to release the foam cores 120, leaving them axially installed within the coil springs 70. When the bar 38 reaches the end of its downward excursion, the relay 104 is deactivated, deenergizing the operator 108 to deenergize the air cylinders 62 to close the jaws 42. Also, at the bottom of the stroke, the normally closed micro switch 110 is opened, deenergizing the relay 112, and opening the contacts 114 and 116. This deenergizes the air cylinders 80, moving the advancement member 76 to the right, advancing the mattress foundation 14 one row of coils 70, completing the cycle and preparing the machine 10 to install another row of foam cores 120 within the next row of coil springs 70. By depressing the push button 90, the sequence explained above is then recommenced.

As explained above, each of the receptacles 18 includes the teeth 30 extending into the interior of the receptacles. As entrained foam cores 120 in each of the receptacles are contacted by the opened jaws 42, the teeth 30 prevent the cores 120 from moving upwardly within the receptacles 18, thus holding the cores firmly in place to be gripped by the jaws 42 when they are closed after the exhaustion of the delay of the time delay 94.

It will be evident from the discussion above that the micro switches 102, 104, 106 and 110, although not illustrated in FIG. 3, are placed appropriately to be contacted during the upward and downward excursion of the transverse bar 38. For example, the micro switches can be located on the left leg (FIG. 2) in proximity to the transverse bar 38 to be contacted at the appropriate point in the sequence as explained above.

Various changes can be made to the invention without departing from the spirit thereof or scope of the following claims.

What is claimed is:

1. An apparatus for inserting foam cores into springs of a structure having a plurality of parallel rows and columns of coil springs, comprising a. means for retaining a plurality of cores in registration with one row of coil springs and at one side of said structure, with each core being retained in alignment with one coil spring, b. a plurality of gripping means located at a side of said structure opposite said one side, each of said gripping means being in alignment with a respective core when held by said retaining means, c. means for inserting each of said gripping means into and withdrawing each of said gripping means from said one coil spring, and d. means for activating each of said gripping means to cause said gripping means to grip and release a foam core.

2. An apparatus according to claim 1 in which said retaining means comprises a plurality of spaced, hollow receptacles each shaped to accommodate one core.

3. An apparatus according to claim 2 in which each receptacle is cylindrical with open ends, and includes means to prevent withdrawing of a core from one end.

4. An apparatus according to claim 3 in which said means to prevent comprises a series of teeth projecting into each receptacle.

5. An apparatus according to claim 1 in which each gripping means is located in a hollow, elongated barrel shaped to pass axially through a coil spring.

6. An apparatus according to claim 1 in which each of said gripping means is secured to a transverse bar.

7. An apparatus according to claim 6 in which said bar is mounted for movement toward and away from said retaining means, and in which said means for inserting and withdrawing comprises at least one air cylinder secured to said bar.

8. An apparatus according to claim 1 in which each of said gripping means comprises a pair of opposed jaws.

9. An apparatus according to claim 8 including a drive member engaging each pair of jaws, said drive member including means for opening and closing said jaws.

10. An apparatus according to claim 9 including an activation rod engaging each drive member, and in which said activating means includes a header connected to each activation rod and at least one air cylinder secured to said header.

11. An apparatus according to claim 1 including means for indexing said structure to align a second row of coil springs with said gripping means and said retaining means.

12. An apparatus according to claim 11 in which said indexing means includes a hook engaging said structure, and at least one air cylinder associated with said hook for driving said hook to advance said structure.

13. An apparatus according to claim 12 including a plurality of said hooks secured to an advancement member, said air cylinder being connected to said advancement member.

14. An apparatus for inserting foam cores into springs of a mattress foundation having a plurality of parallel rows and columns of coil springs, comprising a. means for supporting a mattress foundation for translation thereon, b. means fixed relative to said supporting means for retaining a plurality of cores in registration with one row of coil springs and at one side of said mattress foundation, with each core being retained in alignment with one coil spring, c. a plurality of gripping means located at a side of said mattress foundation opposite said one side, each of said gripping means being in alignment with a respective core when held by said retaining means, d. means for inserting each of said gripping means into and withdrawing each of said gripping means from said one coil spring, e. means for activating each of said gripping means to cause said gripping means to grip and release a foam core, and f. means for indexing said structure on said supporting means to align a second row of coil springs with said gripping means and said retaining means.

15. An apparatus according to claim 14 in which said retaining means comprises a plurality of spaced, hollow receptacles each shaped to accommodate one core.

16. An apparatus according to claim 14 in which each of said gripping means is secured to a transverse bar mounted for movement toward and away from said retaining means, and in which said means for inserting and withdrawing comprises at least one air cylinder secured to said bar.

* * * * *